US007901753B2

(12) United States Patent
Carr et al.

(10) Patent No.: US 7,901,753 B2
(45) Date of Patent: Mar. 8, 2011

(54) SYNTHETIC RUNWAY SURFACE SYSTEM

(75) Inventors: Patrick J. Carr, Tinley Park, IL (US); Dale L. Collett, Sedalia, CO (US)

(73) Assignee: AvTurf L.L.C., Southlake, TX (US)

( * ) Notice: Subject to any disclaimer, the term of this patent is extended or adjusted under 35 U.S.C. 154(b) by 159 days.

(21) Appl. No.: 10/987,482

(22) Filed: Nov. 12, 2004

(65) Prior Publication Data

US 2005/0129903 A1 Jun. 16, 2005

Related U.S. Application Data

(60) Provisional application No. 60/519,572, filed on Nov. 12, 2003.

(51) Int. Cl.
*B32B 3/06* (2006.01)
*B32B 3/08* (2006.01)
*B64F 1/36* (2006.01)

(52) U.S. Cl. ..... 428/62; 244/114 R; 428/57; 428/61; 428/17; 428/85

(58) Field of Classification Search ..... 428/95, 428/17, 87, 57, 61, 62, 85; 244/114 R
See application file for complete search history.

(56) References Cited

U.S. PATENT DOCUMENTS 3,625,011 A * 12/1971 Stevenson ..... 405/36
3,664,241 A 5/1972 Blackburn
3,687,021 A 8/1972 Hensley
3,735,988 A 5/1973 Palmer et al.
3,935,352 A 1/1976 Toland
3,967,704 A * 7/1976 Ogden ..... 404/6
3,968,041 A 7/1976 De Voss
3,995,079 A 11/1976 Haas, Jr.
4,011,022 A * 3/1977 Welty ..... 404/40
4,044,179 A 8/1977 Haas, Jr.
4,047,491 A 9/1977 Spanel et al.
4,067,757 A 1/1978 Layman
4,152,473 A 5/1979 Layman
4,216,735 A 8/1980 McDaniel, Jr.
4,312,504 A * 1/1982 Rutledge et al. ..... 472/92
4,337,283 A 6/1982 Haas, Jr.
4,381,622 A 5/1983 Spidell (Continued)

FOREIGN PATENT DOCUMENTS

CA 1182485 2/1985

(Continued)

OTHER PUBLICATIONS

Control-problem Accidents. Commercial Jet Transport Aircraft 1958-1993, Flight Safety Digest, Dec. 1994.

(Continued)

*Primary Examiner* — Cheryl Juska
(74) *Attorney, Agent, or Firm* — K&L Gates LLP

(57) ABSTRACT

The present invention provides an artificial turf runway surface suitable for supporting take off, landing and taxiing of aircraft. The turf system cures many of problems and pitfalls associated with natural sand or grass systems, such as rutting, bare spots, erosion, unevenness, standing water as well as other problems associated with natural grass airstrips. The synthetic surface also removes nesting materials and food and thereby dissuades birds and other animals from landing and congregating thereon. The system includes a synthetic covering, such as an artificial turf covering, one or more sheeting or flow through membranes, a compacted rock base suitable for supporting the aircraft when landing, tacking off and taxiing.

20 Claims, 3 Drawing Sheets

U.S. PATENT DOCUMENTS

| | | | | |
|---|---|---|---|---|
| 4,396,653 | A | 8/1983 | Tomarin | |
| 4,462,184 | A | 7/1984 | Cunningham | |
| 4,489,115 | A | 12/1984 | Layman et al. | |
| 4,497,853 | A | 2/1985 | Tomarin | |
| 4,637,842 | A | 1/1987 | Jeffrey et al. | |
| 4,662,778 | A | 5/1987 | Dempsey | |
| 4,755,401 | A | 7/1988 | Friedrich et al. | |
| 4,948,116 | A | 8/1990 | Vaux | |
| 5,205,068 | A | 4/1993 | Solomou | |
| 5,206,058 | A | 4/1993 | Fry et al. | |
| 5,303,523 | A | 4/1994 | Hand et al. | |
| 5,392,723 | A | 2/1995 | Kaju | |
| 5,439,968 | A | 8/1995 | Hyche | |
| 5,489,317 | A | 2/1996 | Bergevin | |
| 5,586,408 | A | 12/1996 | Bergevin | |
| 5,672,352 | A | 9/1997 | Clark et al. | |
| 5,850,708 | A | 12/1998 | Bergevin | |
| 5,902,414 | A | 5/1999 | Keal et al. | |
| 5,932,357 | A | 8/1999 | Coates et al. | |
| 5,958,527 | A | 9/1999 | Prevost | |
| 5,976,645 | A * | 11/1999 | Daluise et al. | 428/17 |
| 5,986,551 | A | 11/1999 | Pueyo et al. | |
| 6,039,767 | A | 3/2000 | Boyes et al. | |
| 6,048,282 | A | 4/2000 | Prevost et al. | |
| 6,132,137 | A * | 10/2000 | Gunter | 405/36 |
| 6,216,389 | B1 | 4/2001 | Motz et al. | |
| 6,277,989 | B1 | 8/2001 | Chakravarty et al. | |
| 6,620,482 | B2 * | 9/2003 | Carr et al. | 428/87 |
| 6,723,412 | B2 | 4/2004 | Prevost | |
| 6,794,007 | B2 * | 9/2004 | Carr et al. | 428/87 |
| 6,946,181 | B2 * | 9/2005 | Prevost | 428/87 |
| 7,175,362 | B2 * | 2/2007 | Carr et al. | 404/17 |
| 2002/0064628 | A1 * | 5/2002 | Carr et al. | 428/170 |
| 2002/0146519 | A1 * | 10/2002 | Carr et al. | 428/17 |
| 2003/0092531 | A1 * | 5/2003 | Daluise | 482/1 |
| 2003/0182855 | A1 * | 10/2003 | Prvost | 47/58.1 R |
| 2003/0215287 | A1 * | 11/2003 | Prevost | 404/71 |
| 2004/0058095 | A1 * | 3/2004 | Carr et al. | 428/17 |
| 2004/0058096 | A1 * | 3/2004 | Prevost | 428/17 |
| 2004/0146352 | A1 * | 7/2004 | Carr et al. | 404/75 |
| 2005/0031803 | A1 | 2/2005 | Prevost | |
| 2005/0129903 | A1 * | 6/2005 | Carr et al. | 428/85 |
| 2006/0088380 | A1 * | 4/2006 | Prevost | 404/75 |
| 2007/0098925 | A1 * | 5/2007 | Daluise | 428/17 |
| 2008/0032069 | A1 * | 2/2008 | Carr et al. | 428/17 |
| 2010/0028078 | A1 * | 2/2010 | Carr et al. | 404/31 |
| 2010/0030709 | A1 * | 2/2010 | Carr | 705/500 |

FOREIGN PATENT DOCUMENTS

| | | |
|---|---|---|
| CA | 1226313 | 9/1987 |
| CA | 1235160 | 4/1988 |
| CA | 2043170 | 11/1992 |
| CA | 2095158 | 10/1994 |
| CA | 2218314 | 9/1998 |
| CA | 2206106 | 12/1998 |
| CA | 2206295 | 12/1998 |
| CA | 2294071 | 12/1998 |
| CA | 2294096 | 12/1998 |
| CA | 2238953 | 11/1999 |
| CA | 2247484 | 3/2000 |
| DE | 3901392 | 7/1990 |
| WO | WO 02/15161 | 2/2002 |
| WO | WO 02/20903 | 3/2002 |

OTHER PUBLICATIONS

Surface Safety: Everyone's Responsibility, Federal Aviation Administration, Publication #: 003099.pm.

LD&A, *Precision Approval Path Indicator System*, www.iesna.org, Jul. 1998.

U.S. Department of Transportation, Advisory Circular, *Standards for Specifying Construction of Airports*, Feb. 1999.

Airport Technology R & D Branch, *Evaluation of Fiber Optic Running Distance—Remaining (RDR) Signs at Pittsburgh Int'l. Airport*, www.airportech.tc.faa.gov, Feb. 2000.

Bird Strike Doesn't Mean No Baseball in Baltimore, Air Line Pilots Association, Feb. 2000.

Ranking the Hazard Level of Wildlife Species to Aviation, Wildlife Society Bulletin, Summer 2000.

Some Significant Wildlife Strikes to Civil Aircraft in the United States, 1990-2000, FAA Wildlife Strike Database U.S. Department of Agriculture National Wildlife Research Center, Jul. 28, 2000.

U.S. Department of Transportation, Advisory Circular, *Standards for Airport Markings*, Dec. 1, 2000.

Affidavit of James A. Grief, Jan. 31, 2003.

Deposition of James A. Grief.

Airport Technology R & D, Branch *Airport Markings Paint and Bead Durability*, www.airportech.tc.faa.gov, Mar. 25, 2003.

http://www.faa.gov/arp/ace/625/whmp.htm, Jul. 13, 2000.

http://www.icao.org/icao/en/jr/5308_arl.htm, Jul. 18, 2000.

hht://www.sciam.com/1999/0999issue/-000scicit4.html, Jul. 19, 2000.

http://www.tc.gc.ca/aviation/aerodrme/birdstke/manual/g/g5.htm, Jul. 19, 2000.

http://www.tc.gc.ca/aviation/aerodrme/brdstke/manual/g/g6-1.htm, Jul. 19, 2000.

http://www.birdstrike.org/, Sep. 25, 2000.

http://www-afsc.saia.af.mil/magazine/htdocs/aprmag97/ap971005.htm, Oct. 23, 2000.

http://www.faarsp.com/e2.html, Jan. 29, 2001.

http://www.faarsp.com/aptsigns. htm, Jan. 29, 2001.

http://www.ntsb.gov/pressrel/2000/000613.html, Aug. 24, 2001.

http://www.abcnews.go.com/sections/us/DailyNews/runway000613.htm, Aug. 24, 2001.

http://www.avweb.com/other/aopa027a.html, Aug. 24, 2001.

http://www.faarsp.com/daily/cy130daily.htm, Aug. 24, 2001.

http://www.faarsp.com/ricats88-99.htm, Aug. 24, 2001.

http://www.faarsp.com/lightguns.htm, Aug. 24, 2001.

http://www.faarsp.com/pdpies97-99.htm, Aug. 24, 2001.

http://www.faarsp.com/rimonthly97-99.htm, Aug. 24, 2001.

http://www.faarsp.com/daily/ritot01-00.htm, Aug. 24, 2001.

http://www.faarsp.com/smgcs.htm, Jan. 29, 2001.

http://www.faarsp.com/h2.html, Aug. 24, 2001.

* cited by examiner

SYNTHETIC RUNWAY SURFACE SYSTEM

PRIORITY CLAIM

This application claims the benefit of U.S. Provisional Patent Application No. 60/519,572, filed Nov. 12, 2003, entitled "Synthetic Runway Surface System", the entire contents of which are hereby incorporated by reference and relied upon.

BACKGROUND OF THE INVENTION

The present invention relates to aviation and more particularly to airport runway surfaces.

Some smaller airfields are known to have natural grass surfaces. Those airfields experience each of the same problems growing and maintaining grass that exist in any type of natural grass setting. For example, grass in such fields can die for a myriad of reasons, leaving muddy ground that becomes rutted or heaved due to moisture. The ground can also dry to the point of creating foreign object debris ("FOD") problems for aircraft. Such natural grass surfaces require watering and feeding, which is time consuming and expensive. Moreover, such natural surfaces provide food and nesting materials for birds and other animals, which are generally unwelcome around aircraft.

Besides the natural hazards to maintaining natural grass, the impact of aircraft exacerbates the degradation of the natural surface. Aircraft landing in wet, muddy and/or bare areas can further rut or heave the natural surface. Moreover, the force created by the aircraft landing gear can destroy the natural grass, especially in conditions where such grass is not healthy or in areas where the root structure of the natural grass is not particularly strong. Such areas can become rutted or heaved as well, making landing thereon difficult Many airstrips that should have irrigation and drainage systems do not have such systems. Moreover, installing such systems incurs cost. Those airstrips over time can become uneven, rutted, heaved and otherwise unsuitable for landing. Eventually the airstrip reaches a level where landing is not safe. At that point, while it may be more economical in the short term to tear out the existing natural grass, regrade the landing strip and thereafter replant new seed or sod, such remedy only begins anew the cycle of natural grass degradation. The same areas which had previously shown problems growing or sustaining grass growth will likely once again experience such problems due the environment and aircraft impact, especially in situations where the airstrip is not properly watered and drained.

A need therefore exists for an economic, rugged and readily implemented system for replacing natural turf surfaces at airstrips and airfields.

SUMMARY OF THE INVENTION

The present invention includes a system, apparatus and method for installation of an artificial or synthetic turf or covering at airfields or airstrips in place of natural grass airstrips. The terms "artificial turf", "artificial grass", "synthetic turf" and "synthetic grass" are used herein interchangeably. Each of those terms refers to the commonly understood artificial turf having a backing with tufted or stitched synthetic grass blades extending therefrom. Those terms also expressly encompass other types of synthetic surfaces, such as synthetic matting, porous plastic and/or rubber materials, and plastic and/or rubber fabrics.

In one preferred embodiment, the surface is made to look like grass and provides an aesthetically pleasing airstrip when installed. The artificial turf can include runway border indicia, any known runway symbol or marking, advertising, logos, airport names, institutional names and any combination of same. The artificial turf runway system can be installed adjacent to any type of concrete, asphalt or other manmade structure, such as a roadway, paved runway, paved taxiway, parking lot, building, etc., or be surrounded completely by natural grass, shrubs, trees, etc.

The turf is installed securely using a number of apparatuses and methods discussed herein, such as via pinning devices, glue, masking, or other adhesive, which each attach the turf to a beam or header, which itself is securely installed to an anchor, such as a concrete anchor. Otherwise, the turf can be supported in its middle sections via those securing apparatuses or via the weight of infill applied to the turf.

The base beneath the turf is compacted, e.g., to greater than 90% compaction and in one preferred embodiment to greater than 95% compaction. The base in one embodiment is crushed rock of different size particles, which are capable of being compacted to a greater extent than, for example, rolled rock or rock particles of the same size.

The crushed stone and compacted base are well-suited for supporting aircraft taking off and landing from the synthetic strip of the present invention. As used herein, the term "aircraft" refers to gliders, any type of small airplane, such as single engine, multi-engine, turbo-prop, bi-plane or tri-plane. It is also possible that the depth of the compacted base could be deep enough to support the weight of a large jet airliner taking off and landing thereon. The term "aircraft" therefore includes larger jet airplanes, as well as other types of aircraft, such as helicopters, hot air balloons, etc. As used herein, "aircraft" also refers to any type or size or unmanned aerial vehicle ("UAV"). These aircraft examples are in no way meant to limit the scope of the invention or to serve as any sort of disavowal or disclaimer.

The turf system is graded so that water flows outwardly towards one or more edges of the system. The artificial turf does not require watering, seeding or separate drainage but instead requires only infrequent maintenance of the system to remove weeds and other sparse grass that may grow through the compacted base. The artificial turf runway therefore provides a stable, lasting, aesthetically pleasing and highly functional landing and takeoff area for aircraft.

The artificial turf surface also removes food and nesting materials for birds and other animals over a relatively large area, tending to dissuade those birds and animals from entering and loitering on the turf system. Further still, the artificial turf, which in one preferred embodiment is made of polypropylene, is fire and bum resistant, and therefore tends to mitigate a fire spreading from an aircraft accident occurring on the system. Still further, the sand or other infill layer tends to absorb noise and engine fuel, which lessens the noise disturbance from propeller engines, turbo-propeller engines or jet engines and reduces accident fires, respectively. Further still, the artificial turf system provides an all-weather structure that can be traversed in rainy or snowy conditions by safety and maintenance vehicles without obstruction.

It is therefore an advantage of the present invention to provide an artificial turf runway system and surface for small, medium and large aircraft.

It is another advantage of the present invention to reduce the possibility of bird strikes and accidents caused by other animals.

It is a further advantage of the present invention to minimize the fuel and fire damage from an aircraft accident.

Moreover, it is an advantage of the present invention to provide a synthetic turf system that reduces noise.

Further still, it is an advantage of the present invention to provide an artificial turf system that provides an all-weather, stable apparatus for emergency and safety vehicles.

Additional features and advantages of the present invention are described in, and will be apparent from, the following Detailed Description of the Invention and the figures.

DETAILED DESCRIPTION OF THE INVENTION

The present invention provides an artificial turf runway surface suitable for supporting takeoff, landing and taxiing of aircraft as that term has been described herein. The turf system cures many of the problems and pitfalls associated with natural grass systems, such as rutting, bare spots, unevenness, standing water as well as other problems associated with natural grass surfaces. The synthetic surface also removes nesting materials and food and thereby dissuades birds and other animals from landing and congregating thereon.

Figure 1:
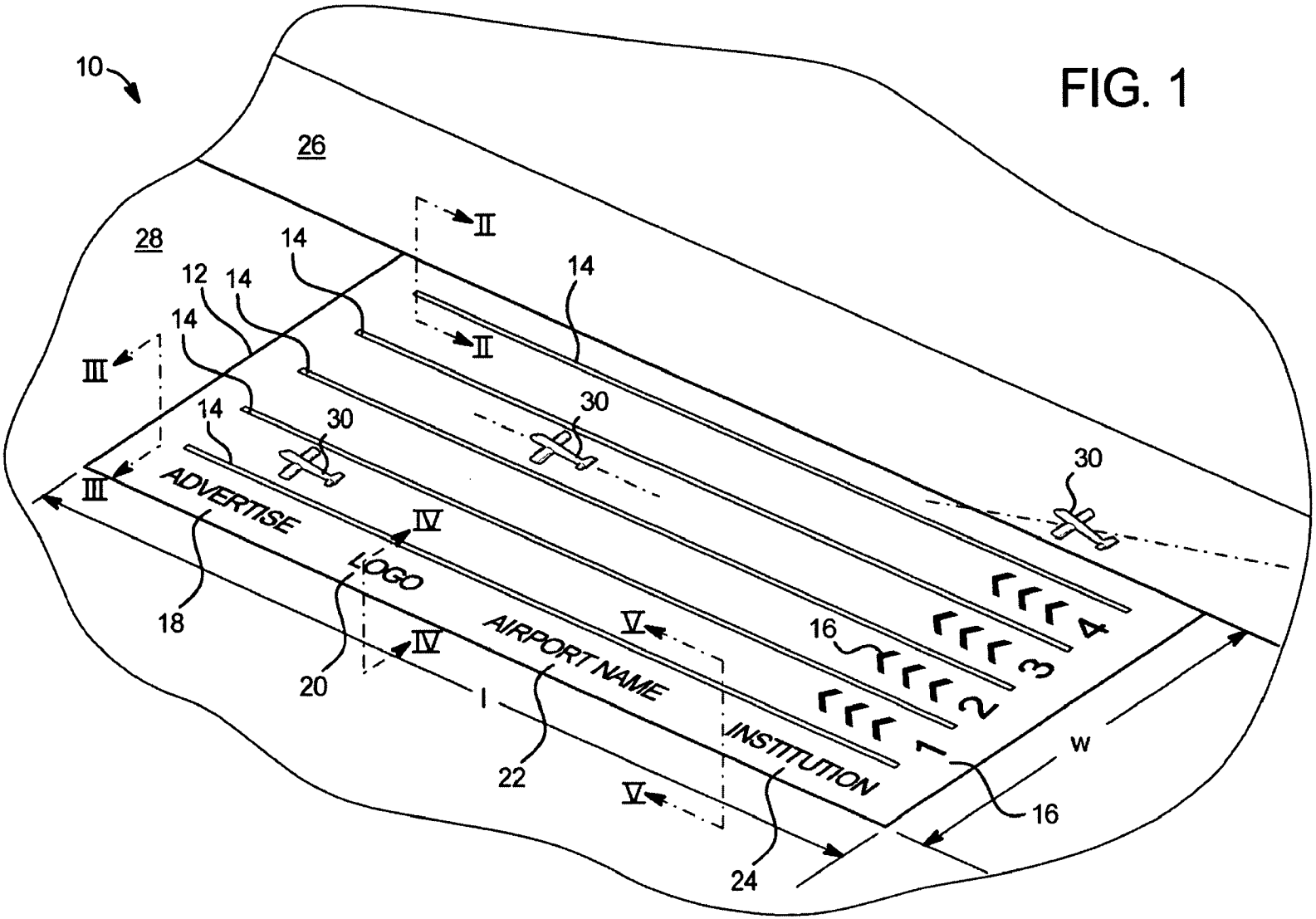
FIG. 1 is a sectioned perspective view of one embodiment of the artificial turf runway system of the present invention.

Referring now to the drawings and in particular to FIG. 1, one embodiment of the synthetic turf system of the present invention is illustrated by system 10. System 10 includes an area of synthetic turf 12. Various preferred embodiments for the synthetic turf used in the present invention are described in U.S. Pat. No. 6,620,482, entitled "Safety System for Airports and Airfields", assigned to the eventual assignee of the present invention, the entire contents of which are expressly incorporated herein by reference. That patent describes an artificial turf having polypropylene fibers in one embodiment tufted or stitched to a backing, which in one embodiment includes a double woven polypropylene layer and a second flexible backing, which is polyurethane. Polypropylene fibers are one preferred type of fiber in this application, which is not a sports field requiring the softer polyurethane fibers. Polypropylene is better-suited for withstanding the riggers of aircraft landings. It should be appreciated however that any suitable turf can be used as the artificial surface 12.

Further, while artificial turf is used in one preferred embodiment, the present invention is expressly not limited to artificial grass, but can instead use any type of synthetic matting, which for example can be porous or perforated. The "turf" specified by element number 12 also includes synthetic coverings that are made of a combination of plastic and rubber, which are bound together in a granulated fashion, and which allow water and moisture to percolate through same.

Artificial turf 12 in one embodiment is green but can have any other color or be of a multitude of colors, any one or more of which can be fluorescent. Turf 12 includes and defines multiple different types of painted-on, sown-in or integral markings, such as runway borders 14, which divide the entire area of turf 12 into multiple runways. The turf markings also include any known type of airport or runway marking, such as the chevron markings 16 shown in FIG. 1. The runway markings 16 also include the runway numbers which are displayed in any suitable fashion and quantity on artificial turf 12. The runway markings are not limited to those shown in FIG. 1 and indeed can include each of the markings shown in U.S. Pat. No. 6,794,007, entitled "Artificial Turf Airport Marking Safety System", assigned to the assignee of the present invention, the entire contents of which are incorporated herein by reference.

Artificial turf 12 also displays other types of markings, such as advertising 18, logos 20, airport names 22, institution names 24 (such as a university name, a company name, a military organization, etc.) and any combination thereof. The present invention expressly contemplates subsidizing the cost of the artificial turf system 10 to the end user by displaying advertising 18 and obtaining revenue from one or more advertisers. Such advertising and revenue can be used to lower the cost of the system 10 to the end user. Advertising can also yield licensing and/or lease fees, which can be paid to either the system installer or to the end user. Thus, system 10 can provide each of the operational and functional advantages described herein as well as provide an ongoing revenue stream to the system supplier and/or the end user.

As illustrated in FIG. 1, artificial turf 12 is adaptable to be installed adjacent to a number of different types of materials and surfaces, such as a paved concrete or asphalt or otherwise non-natural surfaces 26 as well as a natural surface 28, which can include any type of grass, shrubs, trees, etc., which may or may not be common to the area in which the system 10 is installed.

System 10 is adaptable to provide virtually any size artificial runway surface, which can be used for one or more aircraft runways. One example for the width and length of turf 12 is a width "w" of 500 feet and a length "l" of 4,500 feet. It should be appreciated however that such numbers are only an example, and the area of turf 12 can be larger or smaller as desired. The area of turf 12 as illustrated shows four separate runways, which can be evenly spaced apart to allow multiple aircraft 30 to land, taxi and/or park on artificial turf surface 12. System 10 is also suitable to be used as a taxiway that may or may not be implemented in combination with a runway.

Figure 2:
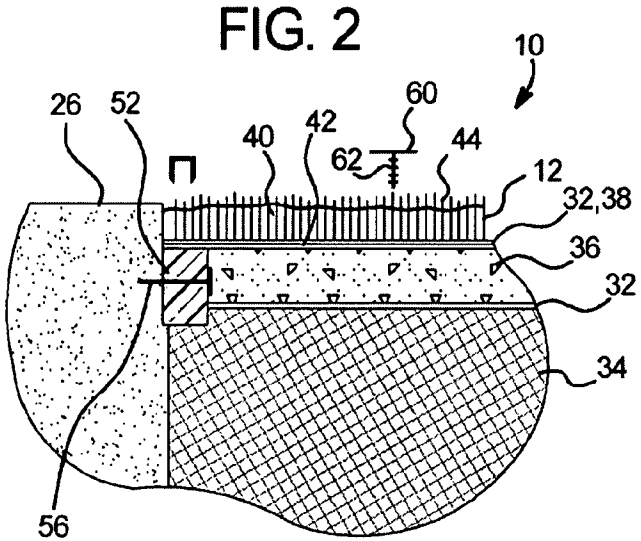
FIG. 2 is an elevation sectioned view taken along line II-II shown in FIG. 1.

Referring now to FIG. 2, a sectioned view taken along line II-II of FIG. 1 is illustrated. The section shows one embodiment for installing turf 12 alongside a concrete, asphalt or otherwise manmade surface 26. System 10 includes a weed barrier 32, which is applied to a compacted and graded surface of a natural material or soil or sand 34. Weed barrier 32 provides one line of defense against the propagation of vegetation, grubs or other insects through the remainder of system 10, including through turf 12. Weed barrier 32 in one embodiment is a plastic or other type of geo-textile fabric that retards upward weed growth and allows a steady and unimpeded stream of water to flow in the opposite direction, namely into soil or sand 34.

A compacted rock or crushed rock base 36 is applied on top of weed barrier 32. Each of the embodiments for the base described in U.S. Pat. No. 6,620,482 is suitable for use in the present invention. The depth of the base 36 in one embodiment is one to twenty inches or deeper. For lighter aircraft, such as gliders, the thickness of the compacted base 36 is in one embodiment about two to three inches and consists of quarter inch minus road base, which is crushed rock having a diameter of about one quarter inch down to rock that has virtually a zero diameter, e.g., sand or dust. The different sized particles enable base 36 to be compressed to a more compacted state than if rolled rock or rock of approximately the same size diameter particulate is used. Such rolled and similarly sized particles create interstices regardless of how much pressure is applied to compact those materials. The quarter inch minus base 36 on the other hand can be compacted to greater than or equal to 90% (less than or equal to 10% air), in one embodiment greater than or equal to 95%, and it may even approach or surpass a 99% level of compaction.

A second weed barrier 32 or sheeting membrane 38 is applied in one embodiment on top of compacted base 36. Upper geo-textile 32 or other suitable fabrics, like lower layer 32, enable water to permeate through same but does not enable weeds, plant life and other vegetation or insects from growing or moving from base 36 and out through turf 12. Alternatively, a substantially water impermeable membrane 38, such as a plastic sheet, is applied on top of base 36 instead of the second weed barrier 32.

The surface of soil or sand 34 and each of the layers applied thereon are graded to a desired slope, such as a 2% slope, which enables water to drain to a desirable area. In FIG. 2, it is likely that the slope will be graded so that water flows away from manmade structure 26. When moisture enters system 10, it permeates through the infill 40 of turf 12, which in one embodiment is compacted sand. The water then flows either through weed barrier 32 to base 36 or flows on top of membrane 38. In either case, the water is generally and gradually moved out of system 10 by flowing along the grade of compacted soil or sand 34. That is, even in the flow-through system employing weed barrier 32, the compaction of base 36 is such that the water tends to flow sideways rather than downwardly through the base 36 (although some downward flow does occur). Indeed, sand infill 40 soaks up much of the water and much of the water therefore drains along the top of a matting 42, which holds the turf fibers 44 in place.

Water that does flow through matting 42 will tend to flow along the top of impermeable membrane 38 or substantially along the top of the compacted base 36. Some of the water eventually flows through compacted base 36. Water that reaches weed barrier 32 is allowed to flow eventually into compacted surface 34. It should be appreciated however that system 10 is configured to mainly move water along the graded surfaces to a desired location within or on the exterior of system 10, which includes suitable drainage that carries water away from the runway, taxiway, etc. System 10 does not require elaborate drainage, which is advantageous from a cost and feasibility standpoint.

For lighter aircraft, such as gliders and UAV's, base 36 can be less substantial. It is expressly contemplated for example to create a quick but functional landing and take-off area for a UAV by simply clearing an area of debris and rolling out a length of turf 12 on the cleared area. The area could be a dirt area or a sand or dessert area. Grass could be removed from the dirt or left beneath turf 12. In any case, the cleared area may or may not be compacted depending on the size of the aircraft and immediacy of the need for a functional airstrip. Different strips of turf 12 can be quickly stitched or glued together to provide a landing strip with a desired length and width.

Turf 12 in one embodiment has a pile height of approximately one-half inch to six inches. In one preferred embodiment, the pile height is about two inches. The sand infill 40 is compacted to about 1⅜ inches to about 1¾ inch in one embodiment. While pure sand is preferred in one embodiment, it should be appreciated that some percentage or all of the infill 40 can be comprised of other materials, such as granulated rubber and/or cryogenically ground rubber particles. It may be desired that a partial or full rubber infill be used in some instances to provide a softer landing. To that end, some or all of the base 36, depending on the size and weight of the intended aircraft, can be of a softer and more compressible material such as sand and/or rubber.

The spacing of the fibers 44 is provided in straight or curves rows, which can be spaced apart from about ¼ inch to about 2½ inches. In one preferred embodiment, the fibers 44 extend past the infill layer 40 a distance of about ⅛ inch to two or more inches. The extension of the fibers 44 over the infill layer 40 helps to prevent sand or other infill 40 particles from flying up into a jet, propeller or turbo-prop engine. Further, the extended pile height prevents sand or other infill type from being dragged up and from being blown or gusted up via ambient wind, becoming a FOD.

In an alternative embodiment, infill 40 is not employed. Such application could allow a relatively inexpensive turf 12 having a short pile height, e.g., one-half inch to be employed. Removing the infill may be desirable if the infill is seen as potentially providing a FOD. It is believed however that the sand or other infill compacts further over time, reducing a likelihood of the infill being kicked-up as an aircraft rolls over turf 12 and system 10. In a further alternative embodiment, infill 40 may include a stabilizer, such as polymer fibers placed within the sand or other infill particles.

Figure 3:
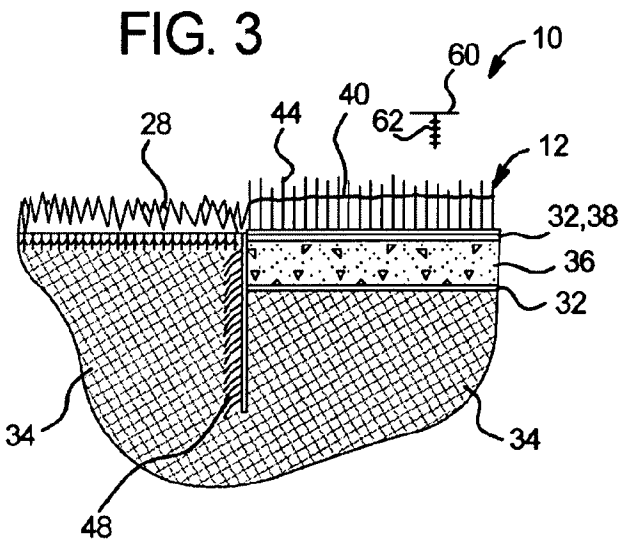
FIG. 3 is an elevation sectioned view taken along line III-III shown in FIG. 1.

Referring now to FIG. 3, a sectioned elevation view taken along line III-III of FIG. 1 is illustrated. FIG. 3 illustrates one embodiment for creating a seam between turf 12 and natural grass 28. Each of the embodiments and alternatives discussed above for turf 12, soil or sand 34, weed barrier 32, compacted base 36 and membrane 38 are applicable to the description in connection with FIG. 3. In FIG. 3, a section of the turf 48 is folded between soil or sand 34 located beneath system 10 and soil or sand 34 beneath natural grass 28. In one embodiment, turf section 48, which can be from about four inches to about 3 feet in length is rolled out past base 36, etc. A trench is dug next to system 10. Turf section 48 is folded into the trench and soil or sand 34 is backfilled and compressed to hold section 48 in place. Sod or grass seed is then planted to grow natural grass 28 adjacent to section 48, which creates an esthetically pleasing and secure seam between the end of system 10 and the beginning of natural grass 28.

Figure 4:
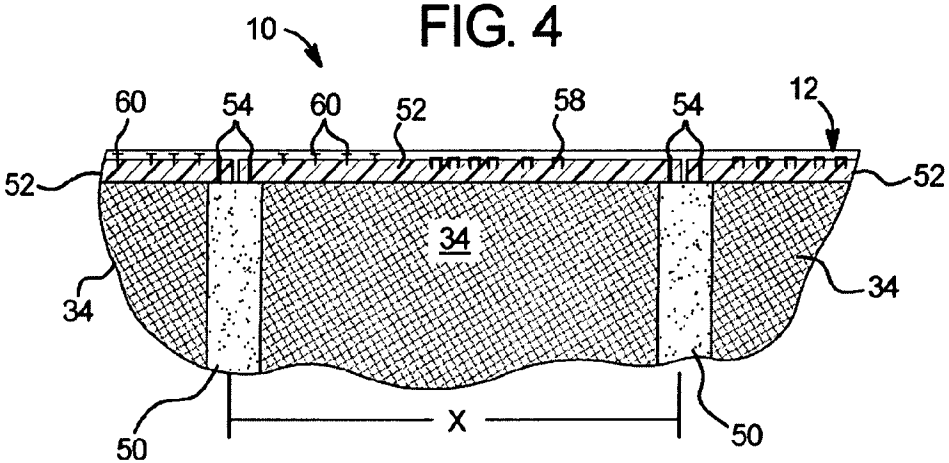
FIG. 4 is a sectioned elevation view taken along IV-IV shown in FIG. 1.
Figure 5:
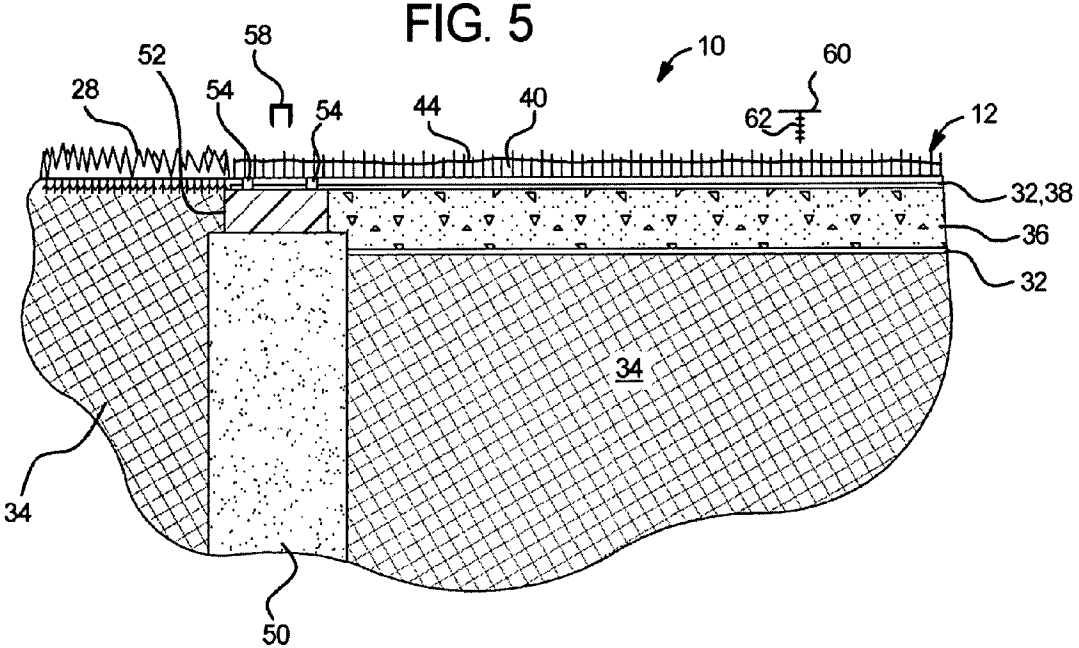
FIG. 5 is a sectioned elevation view taken along V-V shown in FIG. 1.

Referring now to FIGS. 4 and 5, sectioned elevation views taken along lines IV-IV and V-V, respectfully, of FIG. 1 show another embodiment for securing an edge of the turf 12 to an edge of the natural grass 28. Each of the element numbers shown here and common to the figures shown above incorporate all of the description and alternatives described above for such numbers. The instant embodiment is shown in two directions in FIGS. 4 and 5.

The attachment system includes a plurality of anchors 50, which are imbedded into soil or sand 34 a suitable distance to provide a secure mounting structure for the edge of turf 12 of system 10. Anchors 50 in one embodiment are concrete anchors, such as eight inch diameter anchors. Alternative anchors 50 are square or rectangular and are made of any suitable material, such as composite plastic, asphalt, metal, or wood. Concrete is desirable in one embodiment because a hole or trench can be dug, wherein the concrete is poured to a desired depth, width and shape.

Anchors 50 can be poured to a depth of about six inches to about six feet or deeper as needed. In one embodiment, the anchors 50 are poured to about two feet. Anchors 50, as shown in FIG. 4, are spaced apart a distance "x", which is suitable to support a plurality of structural headers 52. Headers 52 in one embodiment are the same headers 52 used in FIG. 2 to secure turf 12 to manmade structure 26. In one embodiment, headers 52 are 2×4 inch or 1×6 inch recycled composite headers. One suitable supplier for headers 52 is Trex™ composite structure produced by Trex™ Company LLC, located at Trex.Com.

Anchors 50 have embedded studs 54 that extend from an end of the anchors. FIGS. 4 and 5 illustrate that anchor 50 supports the ends of two studs 52. FIG. 5 illustrates that each header 52 defines two holes or apertures that receive the studs 54 extending from anchors 50. Anchors 50 are spaced apart a distance "x", which is in one embodiment from about eight feet to about twenty feet. Distance "x" may be set by the longest length available for header 52. For example, a Trex™ header described above comes in lengths of 16 feet, so that distance "x" is either 16 feet or slightly bigger to allow a small gap to exist between headers 52 for expansion and contraction. Studs 54 extending from anchors 50 can be threaded so that the headers 52 are held against anchors 50 via nuts (not illustrated) that fasten to studs 54.

The concrete anchors 50 as well as the side of manmade structure 26 in one embodiment are saw cut to provide a flush and even surface for abutting against headers 52. Anchors 50 are saw cut (around studs 54) to create level supports as seen in FIG. 4, so that headers 52 are substantially horizontal or are angled at the desired grade of soil 44. FIG. 2 shows an alternative embodiment for attaching the stud 52 to manmade structure 26. In FIG. 2, a ramset 56 is used in bolt or pin header 52 against the saw cut and flush edge of manmade structure 26. Further, header 52 can be glued or mastiqued to either one or both the manmade structure 26, which in one embodiment is a long concrete or asphalt structure, or to the top surface of anchors 50.

Glue or mastique can be used in a number of places in system 10 to help secure turf 12 to, for example, upper weed barrier 32 or membrane 38. Further, mastique or glue can be applied between barrier 32/member 38 and the backing of turf 12 or between barrier 32/member 38 and header 52. Other devices are also used to secure of turf 12 to base 36 and soil or sand 34. For example, U-shaped staples 58 or T-shaped pinning devices 60 can be hammered through turf 12 into base 36 and potentially through base 36 into soil or sand 34. Either the staples 58 or the pinning devices 60 can include ribbed apparatuses 62 that help prevent pinning devices 60 or staples 58 from dislodging from the materials to which they are attached.

Figure 8:
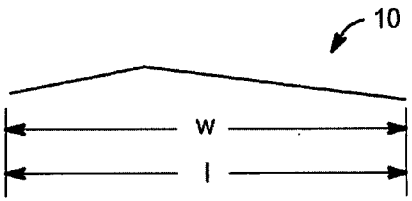
FIGS. 6 to 8 are schematic illustrations showing various embodiments for grading the synthetic turf systems of the present invention.
Figure 7:
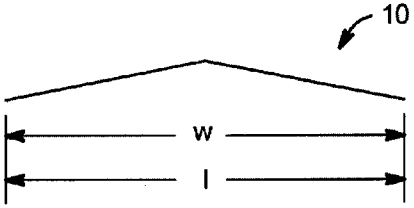
Figure 6:
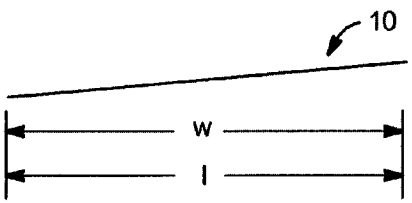

Referring now to FIGS. 6 to 8, various embodiments for the graded system 10 are shown schematically. System 10 is adaptable to fit virtually any type of environment and be placed in any type of geographical location. The goal as stated above is to move water and moisture away from system 10 to the outlying natural grass areas 28 shown in FIG. 1. The topography and location of manmade structures, such as structure 26, dictate generally how the system 10 should be graded.

FIGS. 6 and 8 show three schematic examples, which include both the width direction "w" and the length direction "l" shown in FIG. 1. That is, the grade can either be lengthwise or widthwise according to one of the profiles. FIG. 6 illustrates a constant grade from one end of the system 10 to the other. It is also possible that the grade can be made constant in length and width directions as shown in FIG. 6. FIG. 7 illustrates a grade that has its highest point located approximately in the middle of width "w" and/or length "l". Again, such a grade can be made in one direction or in both length and width directions. FIG. 8 illustrates another example where the highest point in system 10 is located off-center in either the width "w" and/or length "l" directions. It should be appreciated that the grade does not have to be perpendicular to any particular dimension "w" or "l". The important feature is that the grade eventually moves water off of system 10 to a suitable location where an external (or internal if desired) drainage system can collect the water and drain it properly.

The system is particularly well-suited for gliders and the present invention expressly contemplates a method for allowing gliders to take off and land on a synthetic turf runway.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A synthetic runway system comprising:

a soil or sand surface;

a base overlying the surface, the base compacted to at least ninety-five percent, the system having a grade in two directions to produce a desired flow of moisture off of the base;

artificial turf overlying the base, the base and the artificial turf having a length greater than or equal to 4,500 feet and a width greater than or equal to 500 feet and extending for a length sufficient so that at least one aircraft can take off and land on the turf, the grade having an apex beneath the base and extending along the length, and wherein the artificial turf is connected to an edge, the edge including a composite header connected to a plurality of spaced apart mounting anchors, the mounting anchors imbedded into the soil or sand and supporting the composite header.

2. The synthetic runway system of claim 1, wherein the surface has at least one characteristic selected from the group consisting of: being compacted and being graded.

3. The synthetic runway system of claim 1, wherein the compacted base includes crushed rock.

4. The synthetic runway system of claim 1, which includes at least one of a weed barrier and an impermeable membrane located between at least one of (i) the artificial turf and the base and (ii) the surface and the base.

5. The synthetic runway system of claim 1, wherein the artificial turf is infilled with at least one material selected from the group consisting of: sand, rock, rubber and polymer fibers.

6. The synthetic runway system of claim 1, wherein the mounting anchors are concrete mounting anchors.

7. The synthetic runway system of claim 1, wherein the composite header is connected to the plurality of spaced apart mounting anchors via at least one embedded stud extending from an end of the anchors.

8. The synthetic runway system of claim 1, wherein the aircraft is selected from the group consisting of: an airplane, glider, helicopter, balloon and unmanned aerial vehicle.

9. A synthetic runway system comprising:

a soil or sand surface;

artificial turf overlying the surface, the artificial turf sized so that at least one aircraft can take off and land on the turf; and the artificial turf connected to an edge, the edge including a composite header connected to a plurality of spaced apart concrete mounting anchors, the mounting anchors imbedded into the soil or sand and supporting the composite header.

10. The synthetic runway system of claim 9, which includes a compacted base between the soil or sand surface and the artificial turf.

11. The synthetic runway system of claim 9, wherein the aircraft is selected from the group consisting of: an airplane, glider, helicopter, balloon and an unmanned aerial vehicle.

12. The synthetic runway system of claim 9, which includes two strips of artificial turf, the strips glued or sown together.

13. The synthetic runway system of claim 12, wherein the two strips are connected to the edge.

14. The synthetic runway system of claim 9, wherein the artificial turf is connected to the edge via at least one of a pinning device and glue.

15. A synthetic runway system comprising:

a soil or sand surface;

artificial turf overlying the surface, the artificial turf having a length greater than or equal to 4,500 feet and a width greater than or equal to 500 feet and sized to form a runway configured so that at least one aircraft can take off and land on the artificial turf;

the artificial turf connected to an edge, the edge including at least two composite headers, each of the two headers connected to a concrete mounting anchor, the mounting anchor imbedded into the soil or sand and supporting the composite headers.

16. The synthetic runway system of claim 15, which includes a compacted base between the soil or sand surface and the artificial turf.

17. The synthetic runway system of claim 15, wherein the aircraft is selected from the group consisting of: an airplane, glider, helicopter, balloon and an unmanned aerial vehicle.

18. The synthetic runway system of claim 15, which includes two strips of artificial turf, the strips glued or sown together.

19. The synthetic runway system of claim 18, which includes first and second studs extending from the anchor, the first stud received in an aperture defined in a first of the at least two headers and the second stud received in an aperture defined in a second of the at least two headers.

20. The synthetic runway system of claim 15, which includes at least one pinning device extended through the artificial turf towards the soil or sand surface.

* * * * *